US009517861B2

(12) United States Patent
Caputa et al.

(10) Patent No.: US 9,517,861 B2
(45) Date of Patent: Dec. 13, 2016

(54) EXPANDABLE BAG

(71) Applicant: Sunbeam Products, Inc., Boca Raton, FL (US)

(72) Inventors: Elif Caputa, Boca Raton, FL (US); Vikki Slavin, Wellington, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 18 days.

(21) Appl. No.: 13/751,496

(22) Filed: Jan. 28, 2013

(65) Prior Publication Data

US 2014/0212078 A1 Jul. 31, 2014

(51) Int. Cl.

| | |
|---|---|
| ***B65D 30/08*** | (2006.01) |
| ***B65D 33/02*** | (2006.01) |
| ***B65D 30/20*** | (2006.01) |
| ***B65D 33/22*** | (2006.01) |
| ***B65D 81/20*** | (2006.01) |

(52) U.S. Cl.

CPC ..... *B65D 31/10* (2013.01); *B65D 31/02* (2013.01); *B65D 33/22* (2013.01); *B65D 81/2023* (2013.01)

(58) Field of Classification Search

CPC ..... B65D 33/255; B65D 31/10; B65D 31/02; B65D 81/2023

USPC ..... 383/109, 119, 120

See application file for complete search history.

(56) References Cited

U.S. PATENT DOCUMENTS

| | | | | |
|---|---|---|---|---|
| 4,526,565 | A * | 7/1985 | Hummel et al. | 493/196 |
| 4,761,080 | A | 8/1988 | Schirmer | |
| 4,913,561 | A | 4/1990 | Beer | |
| 5,893,461 | A | 4/1999 | Walters | |
| 6,070,728 | A | 6/2000 | Overby et al. | |
| 6,126,315 | A | 10/2000 | Ichikawa et al. | |
| 6,332,711 | B1 | 12/2001 | Inuzuka et al. | |
| 7,093,978 | B2 | 8/2006 | Tan | |
| 7,223,017 | B2 | 5/2007 | Weaver | |
| 7,585,528 | B2 * | 9/2009 | Ferri et al. | 426/110 |
| 2004/0013325 | A1 | 1/2004 | Cook | |
| 2004/0022456 | A1 * | 2/2004 | Hanson | 383/8 |
| 2005/0041894 | A1 | 2/2005 | Hanson | |
| 2006/0013514 | A1 * | 1/2006 | Wu | B65D 31/02 383/109 |
| 2007/0133908 | A1 | 6/2007 | Bruns | |
| 2007/0217719 | A1 * | 9/2007 | Smith | 383/66 |
| 2008/0085823 | A1 | 4/2008 | Reggi | |
| 2009/0166237 | A1 * | 7/2009 | Gaskell et al. | 206/439 |

(Continued)

*Primary Examiner* — Derek Battisti

(74) *Attorney, Agent, or Firm* — Michael J. Corrigan

(57) ABSTRACT

An expandable food storage bag is provided having gusseted sides so that larger food or other items may be inserted therein before vacuum heat sealing. The bag includes first and second sidewalls having a first thickness and a first oxygen transmission rate. The bag further includes first and second gusseted sidewalls having a second thickness less than the first thickness and a second oxygen transmission rate substantially equal to or less than the first oxygen transmission rate. The first pleated sidewall interconnects one side of the first and second sidewalls. The second gusseted sidewall interconnects an opposite side of the first and second sidewalls. The thinner gusseted sidewalls allow the bag to be heat sealed with the first and second sidewalls that may be otherwise too thick with gusseted sidewalls of the same thickness as the first and second sidewalls while maintaining a substantially equal or less oxygen transmission rate.

26 Claims, 2 Drawing Sheets

(56) References Cited

U.S. PATENT DOCUMENTS

| | | | | |
|---|---|---|---|---|
| 2010/0014790 | A1 | 1/2010 | Colla | |
| 2010/0180548 | A1 | 7/2010 | Binger | |
| 2010/0226598 | A1 | 9/2010 | Stoeppelmann | |
| 2010/0284633 | A1 | 11/2010 | Dytchkowskyj et al. | |
| 2011/0069911 | A1* | 3/2011 | Ackerman et al. | 383/64 |
| 2011/0150368 | A1* | 6/2011 | Ellsworth et al. | 383/6 |
| 2011/0255809 | A1* | 10/2011 | Tucker et al. | 383/119 |
| 2014/0147059 | A1* | 5/2014 | Tan | 383/7 |

* cited by examiner

EXPANDABLE BAG

CROSS-REFERENCE TO RELATED APPLICATION

The present application claims priority to U.S. Provisional Patent Application No. 61/590,985 filed Jan. 26, 2012, which is incorporated by reference as if fully rewritten herein.

FIELD OF THE INVENTION

The invention relates generally to food preservation. More particularly, the invention is directed to a vacuum sealing food storage bag having expanding gusseted sidewalls with reduced thickness as compared to the main sidewalls and made from a material having an oxygen transmission rate substantially equal to that of the material forming the main sidewalls of the bag to facilitate heat sealing.

BACKGROUND OF THE INVENTION

Preservation of food and food portions is important for a variety of economic, health, and convenience reasons. Food can be stored for longer periods of time if oxygen is excluded and the harmful effects of oxygen on food are minimized. Sealed bags have long been used to store and transfer perishable foods and other products on their way to market for purchase by consumers. After perishable foods, such as meats, fruits, and vegetables are harvested, they may be placed into an open end of a bag formed from a material capable of being heat sealed. The bag may be evacuated and the open end of the bag sealed by a vacuum sealing appliance to protect the contents from the spoiling effects of oxygen.

Prior art vacuum sealing bags can only handle up to a certain size of food, meat, or fish, which can sometimes require a lot of time and effort to cut into smaller portions to fit into the bag for vacuuming and sealing.

SUMMARY OF THE INVENTION

In an embodiment, there is provided an expandable food preservation and storage bag, including a first and second sidewall having a first thickness and a first oxygen transmission rate, a first gusseted sidewall having a second thickness less than the first thickness and a second oxygen transmission rate substantially equal to or less than the first oxygen transmission rate, the first gusseted sidewall interconnecting one side of the first and second sidewalls, and a second gusseted sidewall having the second thickness and the second oxygen transmission rate, the second gusseted sidewall interconnecting an opposite side of the first and second sidewalls.

In an embodiment, there is provided a flexible container including a first and second panel having a first thickness and a first oxygen transmission rate, a first gusseted panel having a second thickness less than the first thickness and a second oxygen transmission rate substantially equal to or less than the first oxygen transmission rate, the first gusseted panel interconnecting one side of the first and second panels, and a second gusseted panel having the second thickness and the second oxygen transmission rate, the second gusseted panel interconnecting an opposite side of the first and second panels.

In an embodiment, there is provided a method of forming a bag, including providing a first and second sidewall having a first thickness and a first oxygen transmission rate, providing a first gusseted sidewall having a second thickness less than the first thickness and a second oxygen transmission rate substantially equal to or less than the first oxygen transmission rate, interconnecting said first gusseted sidewall to one side of the first and second sidewalls, providing a second gusseted sidewall having the second thickness and the second oxygen transmission rate, and interconnecting the second gusseted sidewall on an opposite side of the first and second sidewalls.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
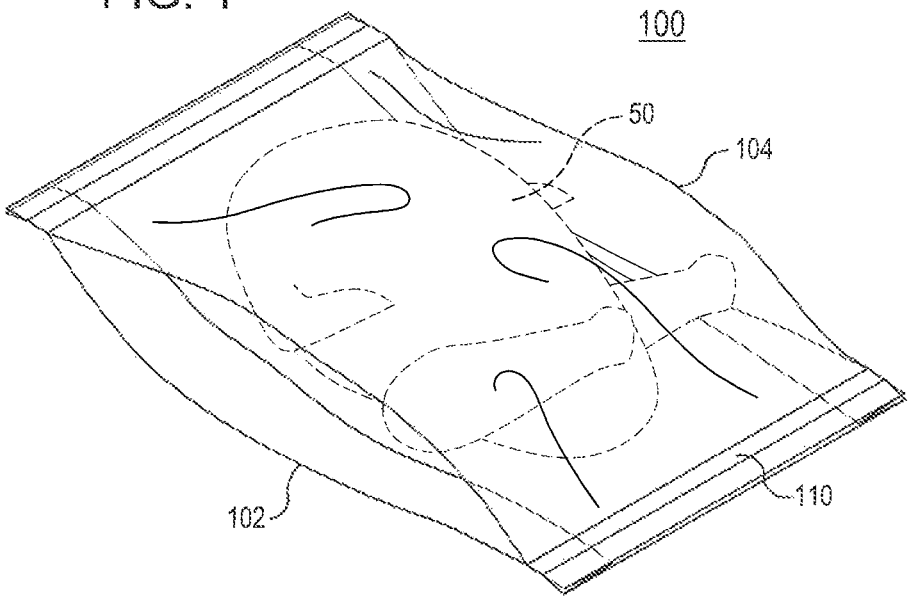
FIG. 1 is a perspective view of a sealed expandable vacuum sealing bag with single fold gusseted expandable sides.
Figure 2:
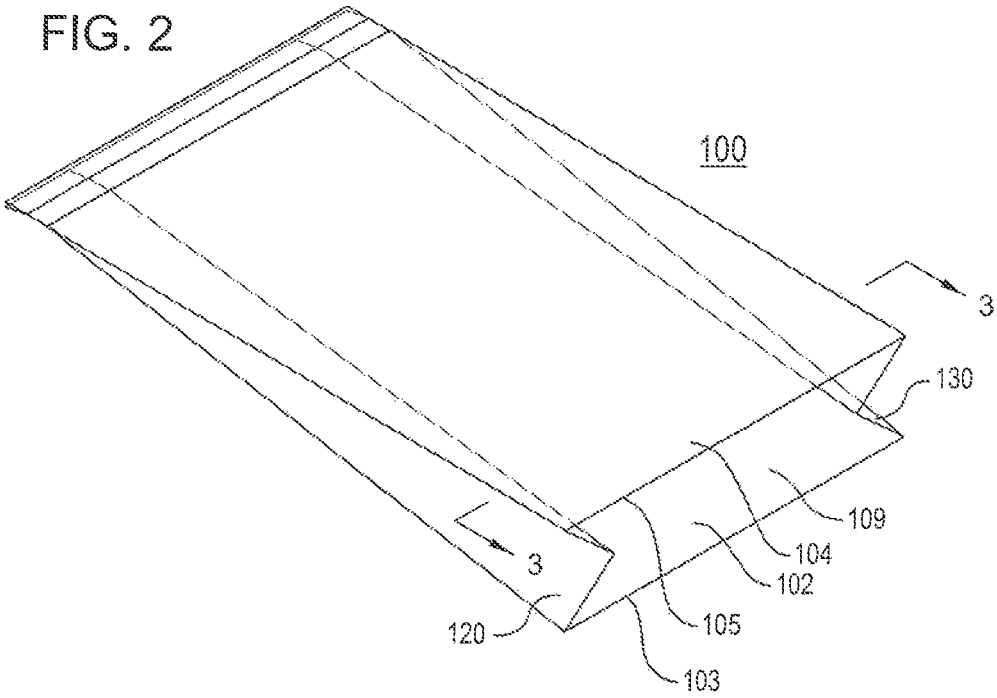
FIG. 2 is a perspective view of the vacuum sealing bag of FIG. 1 with an unsealed open end.

Referring to FIGS. 1 and 2, an embodiment of an expandable food storage vacuum sealing bag 100 is provided for storing perishable foods 50 such as meats, fruits, and vegetables. It should be understood that this embodiment is non-limiting as other expandable bags capable of being heat sealed may be contemplated. The vacuum sealing bag 100 includes a first sidewall 102 of a generally planar shape and a second sidewall 104 also of a generally planar shape. The first and second sidewalls 102, 104 are formed from a non-porous material having a low oxygen transmission rate (OTR) including but not limited to nylon. A material is considered "a high oxygen barrier" if its oxygen transmission rate is less than 1 cc/100 $in^2$/24 hr. Other examples of packaging films having low oxygen transmission rates are shown in Table 1.

In an embodiment, the first and second sidewalls 102, 104 are 3 mil (three-thousands of an inch) multi-layer PE (polyethylene)/Nylon film having an oxygen transmission rate of 3 cc/100 $in^2$/24 hr. However, this is not meant to be limiting as other sidewall 102, 104 thicknesses may be selected, preferably in the 3 mil to 6 mil range. The sidewalls 102 and 104 may be embossed to provide a pathway for the evacuation of air from a formed vacuum sealing bag 100 prior to sealing the open ends 103, 105 of the vacuum sealing bag 100 with a conventional vacuum sealing appliance. Such vacuum sealing appliances evacuate air from within the interior of the bag 100 and apply heat to the open ends 103, 105 of the vacuum sealing bag to seal the open ends 103, 105 together to form an air and liquid tight seal 110. In an embodiment, the first sidewall 102 is non-embossed so that when the first and second sidewalls 102, 104 are forced against each during evacuation of the vacuum sealing bag 100 pathways are formed there between by the embossed inner surface of the second sidewall 104 and the smooth inner surface of the first sidewall 102.

The first and second sidewalls 102, 104 are interconnected to each other on opposite sides by first and second gusseted sidewalls 120, 130. The first and second sidewalls 102, 104 are interconnected to the respective first and second gusseted sidewalls 120, 130 along their entire edges by welding including but not limited to sonic welding. The first and second gusseted sidewalls 120, 130 are each comprised of one or more folds so that when the first and second sidewalls 102, 104 are moved in opposite directions away from each other the first and second sidewalls 102, 104 remain interconnected at their sides. This expansion allows larger food items to be inserted into the interior of the sealing bag 100 as compared to prior art sealing bags. In an embodiment, the gusseted sidewalls 120, 130 are not embossed. In another embodiment, one or both of the gusseted sidewalls 120, 130 are embossed.

In use, the vacuum sealing bags 100 may be pre-formed and cut with one end pre-sealed (such as the bag 100 shown in FIG. 1) so that a vacuum sealing bag 100 is formed with open ends 103, 105 of the first and second sidewalls 102, 104 partially forming an opening 111 where foods 50 may be inserted into the vacuum sealing bag 100. Alternately, the vacuum sealing bags 100 may be formed by cutting a section of bag material from a roll of bag material. The first and second sidewalls 102, 104 are interconnected to each other on opposite sides by the gusseted sidewalls 120, 130 at the factory. One of the open ends of the cut section of bag material is then heat sealed. Thereafter, the remaining open end of the partially formed bag 100 is heat sealed in a vacuum sealing machine after the food 50 is placed in the interior volume of the bag 100.

Figure 3:
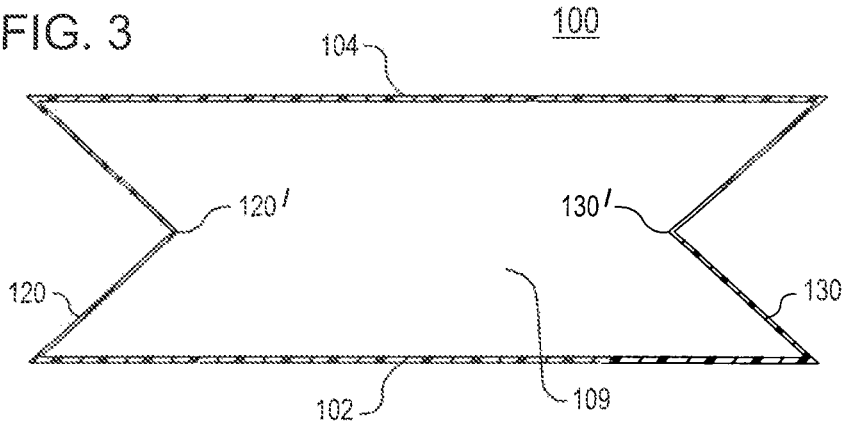
FIG. 3 is a cross-sectional view of the bag of FIG. 3 taken along line 3-3 of FIG. 2.

Referring now also to FIG. 3, in an embodiment the gusseted sidewalls 120, 130 are each comprised of at least one fold 120' 130' so that when the first and second sidewalls 102, 104 are sandwiched together prior to heat sealing there are a minimum of four layers of bag material sandwiched together in the area of the vacuum sealing bag 100 to be heat sealed. This may be problematic with conventional vacuum sealing appliances since the greater thickness of the four layers of bag material may prevent the open end of the sealing bag 100 to seal properly when heat is applied. As a result, the thickness of the gusseted sidewalls 120, 130 may be reduced or less than the thickness of the first and second sidewalls 102, 104 to facilitate heat sealing despite the increased aggregate thickness due to the four layers of bag material.

In an embodiment, the thickness of the gusseted sidewalls 120, 130 is 2.4 mil thick. In order to compensate for the reduced thickness of the gusseted sidewalls 120, 130, the material forming the gusseted sidewalls 120, 130 may be comprised of a multilayer PE (polyethylene)/EVOH (ethylene vinyl alcohol) film which has an oxygen transmission rate at the reduced 2.4 mil thickness substantially equal to or less than the oxygen transmission rate of the 3 mil thick first and second sidewalls 102, 104 formed from the multi-layer PE (polyethylene)/Nylon film. However, this is not meant to be limiting as the gusseted sidewalls 120, 130 may be comprised of other packaging materials having the desired characteristics at a suitable thickness including but not limited to those shown in Table 1.

TABLE 1

| Film Type | OTR @ 73° F. (23° C.), 0% RH (cc/100 in$^2$/24 hr) | (cc/m$^2$/24 hr) |
|---|---|---|
| The following OTRs are bulk material properties displayed at 1 mil. Divide by the gauge (in mil) in order to approximate OTR at a different thickness. | | |
| EVOH* (ethylene vinyl alcohol) | .005-.12 | .08-.19 |
| Biax Nylon-6 | 1.2-2.5 | 18.6-39 |
| OPET (oriented polyester) | 2-6 | 31-93 |
| OPP | 100-160 | 1550-2500 |
| Cast PP | 150-200 | 2300-3100 |
| HDPE (high density polyethylene) | 150-200 | 2300-3100 |
| OPS (oriented polystyrene) | 280-400 | 4350-6200 |
| LDPE (low density polyethylene) | 450-500 | 7000-8500 |
| The following OTRs are enhanced by coating or metallizing. Therefore, these are not bulk film properties, and total film thickness has little impact on the OTR value. | | |
| Metallized OPET | .01-.11 | .16-1.7 |
| PVOH-coated OPP (AOH) | .02 | .31 |
| Metallized biax Nylon-6 | .05 | .78 |
| PVdC-coated OPET | .30-.50 | 4.7-7.8 |
| High Barrier PVdC-coated OPP | .30-.60 | 4.7-9.3 |
| PVdC-coated biax Nylon-6 | .35-.50 | 4.7-7.8 |
| Metallized OPP | 1.2-10 | 19-160 |
| Scalable PVdC-coated OPP | 1.5-3.5 | 23-54 |

Figure 4:
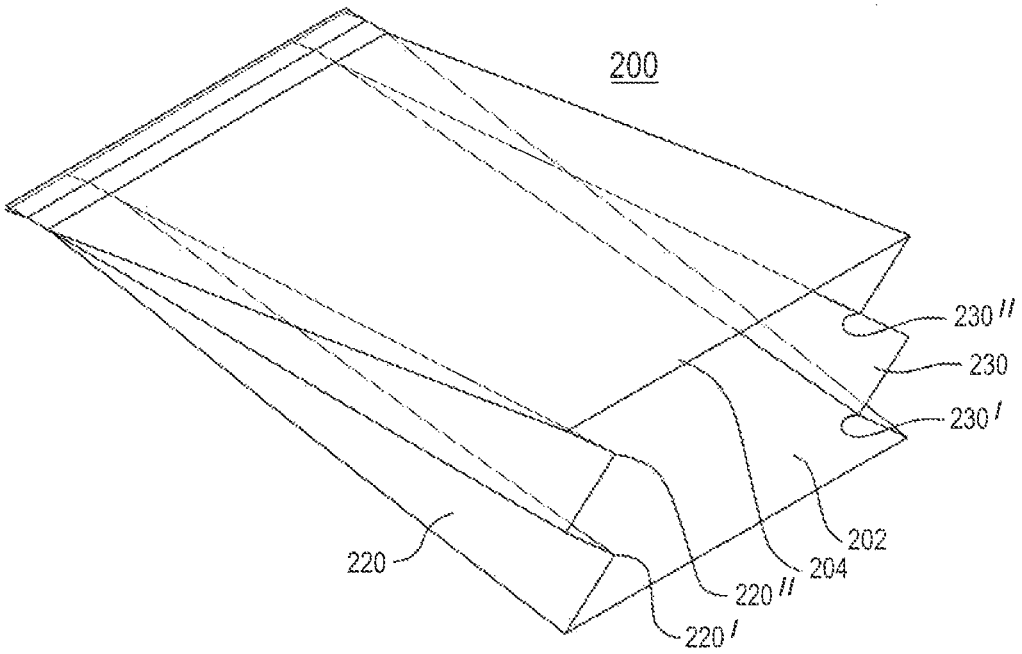
FIG. 4 is a perspective view of a vacuum sealing bag with multiple fold gusseted expandable sides with an unsealed open end.

Referring now to FIG. 4, another embodiment sealing bag 200 similar to the previous embodiment sealing bag 100 is illustrated having gusseted sidewalls 220, 230 comprised of a plurality of folds 220', 220" 230' 230" so that when first and second sidewalls 202, 204 are sandwiched together prior to heat sealing there are multiple layers of bag material sandwiched together in the area to be heat sealed together to form a seal. As a result, the thickness of the gusseted sidewalls 220, 230 may be reduced or less than the sidewalls 202, 204 to facilitate heat sealing despite the increased aggregate thickness due to the multiple layers of bag material. The material selected for the gusseted sidewalls 220, 230 at the reduced thickness is selected based on it having an oxygen transmission rate that is substantially equal or less than the oxygen transmission rate of the thicker first and second sidewalls 202, 204 as described above.

For example, in a non-limiting embodiment, the first and second sidewalls 202, 204 are 3 mil (three-thousands of an inch) multi-layer PE (polyethylene)/Nylon film having an oxygen transmission rate of 3 cc/100 in$^2$/24 hr. The material forming the gusseted sidewalls 220, 230 may be comprised of a multilayer PE (polyethylene)/EVOH (ethylene vinyl alcohol) film which has an oxygen transmission rate at the reduced 2.4 mil thickness substantially equal to or less than the oxygen transmission rate of the 3 mil thick first and second sidewalls 202, 204 formed from the multi-layer PE (polyethylene)/Nylon film. However, this is not meant to be limiting as other gusseted sidewall 220, 230 materials and thicknesses may be selected.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An expandable food preservation and storage heat-sealable vacuum hag, comprising:

a first and second sidewall having a first thickness and a first oxygen transmission rate, wherein said first sidewall is positioned to overlay the second sidewall during heat sealing of an open end of said heat-sealable vacuum hag;

a first gusseted sidewall including at least a first fold, said first gusseted sidewall having a second thickness less than the first thickness and a second oxygen transmission rate substantially equal to the first oxygen transmission rate, said first gusseted sidewall interconnecting one side of the first and second sidewalls;

a second gusseted sidewall including at least a second fold, said second gusseted sidewall having the second thickness and the second oxygen transmission rate, said second gusseted sidewall interconnecting an opposite side of the first and second sidewalls; and wherein at least said first and second folds of said first and second gusseted sidewalls are sandwiched and encompassed entirely between the first and second sidewalls at the open end of said heat-sealable vacuum hag during heat sealing.

2. The bag of claim 1, wherein the first thickness is 3 mil.

3. The bag of claim 1, wherein the first thickness is in the 3 mil to 6 mil range.

4. The bag of claim 1, wherein the second thickness is 2.4 mil.

5. The bag of claim 1, wherein the first oxygen transmission rate is 3 cc/100 $in^2$/24 hr.

6. The bag of claim 1, wherein the second oxygen transmission rate is 3 cc/100 $in^2$/24 hr.

7. The bag of claim 1, wherein the first sidewall is embossed.

8. The bag of claim 1, wherein the second sidewall is embossed.

9. The bag of claim 1, wherein the first and second sidewalls are embossed.

10. The bag of claim 1, wherein the first and second sidewalls are formed from a sheet of film including multi-layer PE (polyethylene)/nylon film.

11. The bag of claim 1, wherein the first and second gusseted sidewalls are formed from a sheet of film including multilayer PE (polyethylene)/EVOH (ethylene vinyl alcohol) film.

12. The bag of claim 1, wherein the first and second gusseted sidewalls are comprised of a single fold.

13. The hag of claim 1, wherein the first and second gusseted sidewalls are comprised of a plurality of folds.

14. The bag of claim 1, wherein the bag is dispensed from a roll of bag material comprised of the first and second sidewalls interconnected to the corresponding first and second gusseted sidewalls.

15. The bag of claim 1, wherein the bag is pre-formed from the first and second sidewalls interconnected to the corresponding first and second gusseted sidewalls and is pre-sealed on three sides and open on one end.

16. The hag of claim 1, wherein the second oxygen transmission rate is less than the first oxygen transmission rate.

17. A flexible heat sealable vacuum container, comprising:

a first and second panel having a first thickness and a first oxygen transmission rate, wherein said first panel is positioned to overlay the second sidewall during heat sealing of an open end of the heat-sealable vacuum container;

a first gusseted panel including at least a first fold, said first gusseted panel having a second thickness less than the first thickness and a second oxygen transmission rate substantially equal to the first oxygen transmission rate, said first gusseted panel interconnecting one side of the first and second panels; and a second gusseted panel including at least a second fold, said second gusseted panel having the second thickness and the second oxygen transmission rate, said second gusseted panel interconnecting an opposite side of the first and second panels;

wherein at least said first and second folds of said first and second gusseted panels are sandwiched and encompassed entirely between the first and second panels at the open end of said heat sealable vacuum container during heat sealing.

18. The flexible container of claim 17, wherein the first thickness is 3 mil.

19. The flexible container of claim 17, wherein the second thickness is 2.4 mil.

20. The flexible container of claim 17, wherein the first oxygen transmission rate is 3 cc/100 $in^2$/24 hr.

21. The flexible container of claim 17, wherein the second oxygen transmission rate is 3 cc/100 $in^2$/24 hr.

22. The flexible container of claim 17, wherein the first panel is embossed.

23. The flexible container of claim 17, wherein the second panel is embossed.

24. The flexible container of claim 17, wherein the first and second panels are formed from a sheet of film including multi-layer PE (polyethylene)/nylon film.

25. The flexible container of claim 17, wherein the first and second gusseted panels are formed from a sheet of multilayer film including PE (polyethylene)/EVOH (ethylene vinyl alcohol) film.

26. A method of forming a heat sealable vacuum bag, comprising:

providing a first and second sidewall having a first thickness and a first oxygen transmission rate;

positioning said first sidewall to overlay the second sidewall during heat sealing of an open end of said heat-sealable vacuum bag;

providing a first gusseted sidewall including at least a first fold, said first gusseted sidewall having a second thickness less than the first thickness and a second oxygen transmission rate substantially equal to the first oxygen transmission rate, interconnecting said first gusseted sidewall to one side of the first and second sidewalls;

providing a second gusseted sidewall including at least a second fold, said second gusseted sidewall having the second thickness and the second oxygen transmission rate; and interconnecting the second gusseted sidewall on an opposite side of the first and second sidewalls, wherein at least said first and second folds of said first and second gusseted panels are sandwiched and encompassed entirely between the first and second panels at the open end of said heat scalable vacuum bag during heat sealing.

* * * * *